United States Patent [19]

Hanula et al.

[11] Patent Number: 4,593,828

[45] Date of Patent: Jun. 10, 1986

[54] ROTARY RAILROAD CAR F COUPLER

[76] Inventors: Richard M. Hanula, 5012 N. Barton Rd., Lyndhurst, Ohio 44124; Karl J. Jwuc, 352 Whittlesey Dr., Tallmadge, Ohio 44278

[21] Appl. No.: 565,899

[22] Filed: Dec. 27, 1983

Related U.S. Application Data

[62] Division of Ser. No. 322,217, Nov. 17, 1981, Pat. No. 4,428,489.

[51] Int. Cl.[4] ..... B61G 9/00

[52] U.S. Cl. ..... 213/62 A; 213/67 R; 213/69; 384/428

[58] Field of Search ..... 213/50, 50.5, 51, 62 R, 213/62 A, 67 R, 69–72; 29/149.5 B, 149.5 C; 384/428

[56] References Cited

U.S. PATENT DOCUMENTS

| | | | |
|---|---|---|---|
| 3,116,539 | 1/1964 | Evans et al. | 29/149.5 B |
| 3,371,398 | 3/1968 | Patterson et al. | 29/149.5 B |
| 4,225,261 | 9/1980 | Marx | 29/149.5 B X |
| 4,230,228 | 10/1980 | Kaim | 213/62 A |
| 4,428,489 | 1/1984 | Hanula | 213/62 A |

*Primary Examiner*—Randolph A. Reese

[57] ABSTRACT

A rotary railroad car F. coupler assembly which employs a rotary connector between the yoke and car coupler, is described as having a yoke with a larger diameter opening in which a bigger rotary connector is mounted. The rotary connector in turn, is designed to receive an AAR standard F coupler head with a heavier shank that has sidewalls, bordering the pinhole in the shank, which are thicker and have greater cross-sectional areas than similar sidewalls of shanks of AAR standard non-rotary type F car couplers.

6 Claims, 6 Drawing Figures

ROTARY RAILROAD CAR F COUPLER

This is a division of application Ser. No. 322,217, filed Nov. 17, 1981, now U.S. Pat. No. 4,428,489.

BACKGROUND OF THE INVENTION

The invention is concerned with rotary railroad car couplers, especially a rotary F-type coupler which employs an AAR Standard F-type coupler head as shown, for example, in U.S. Pat. No. 2,973,105 which is directed to a rotary F coupler whose shank is pinned to a rotary connector which, in turn, is mounted within the yoke for rotation about the coupler axis.

The tremendous growth in the size of railroad cars in the past decade has placed severe strains on railroad car coupler assemblies, including the car coupler, striker, yoke and draft gear. Moreover, railroad beds in disrepair cause misalignment of the trackway which produces undesirable movement between adjacent railroad cars thereby creating heretofore unknown fatigue failures in components of the car coupler assemblies. The invention is directed to increasing the size of the essential components of a rotary F car coupler assembly to meet these increasing stresses which the assemblies are being subjected.

Briefly stated, the invention is in a rotary railroad car F coupler assembly which is mounted within a standard carsill housing that has a generally rectangular cross-section configuration and is secured to the underside of a railroad car. A yoke, disposed in the housing, is provided with a longitudinally extending cylindrical opening. A wearplate is positioned between the top of the yoke, closest the railroad car, and the adjacent underside of the housing. A connector is mounted in the opening of the yoke for rotation about the longitudinal axis of the yoke. The connector is provided with a pair of aligned pinholes which extend laterally from an opening which extends longitudinally through the connector. A car coupler, including a coupler head that protrudes from the yoke and a shank which extends from the head in the direction of the yoke and terminates at a butt end which extends through the opening of the rotary connector into seating engagement against an adjacent front follower which is spring loaded by the draft gear mechanism, is pinned to the connector for unitary rotation. A cover plate is secured to the underside of the housing in spaced relation from the car to close the housing and help support the yoke.

The size of the rotary connector and the coupler shank, adjacent the pinhole in the shank, are substantially increased by using a pair of twin, parallel wearplates between the top of the yoke and adjacent underside of the housing. The twin wearplates are spaced a sufficient distance apart so that the top portion of the yoke, closest the railroad car, can be expanded upwardly between the wearplates closer the housing, so that the diameter and consequent cross-sectional area of the cylindrical opening of the yoke can be substantially increased, without radically changing the overall size of the yoke so that it won't fit into the standard carsill housing. The rotary connector and the butt end of the coupler shank are enlarged accordingly, to provide a larger yoke and connector which are undiminished in strength, and a coupler shank whose strength in the area of the pinhole is greatly enhanced, so that the coupler is less susceptible to fracturing and breakage.

DESCRIPTION OF THE DRAWINGS

The following description of the invention will be better understood by having reference to the accompanying drawing, wherein.

ENVIRONMENT OF THE INVENTION

Figure 1:
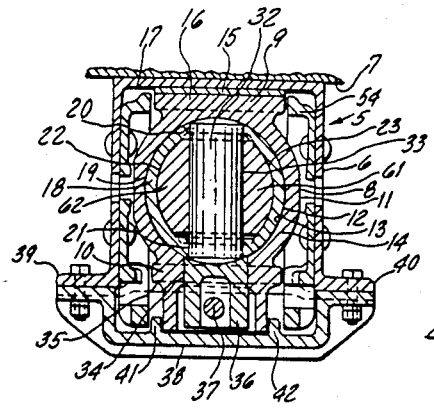
FIG. 1 (PRIOR ART)
FIG. 1 is a duplication of FIG. 4 of U.S. Pat. No. 2,973,105 and illustrates the transverse cross-section of a prior art rotary F car coupler assembly.

With general reference to the drawing for like parts, and specific reference to FIG. 1, there is shown a prior art rotary F-type railroad car coupler assembly 5 which, when in a horizontal pull position, comprises a standard carsill housing 6 that is secured to the underside 7 of a railroad car, the bottom of the housing farthest from the car being open. A yoke 8 is conventionally provided with a pair of upper and lower straps 9,10 which extend rearwardly from the front end 11 of the yoke 8 that is provided with a longitudinally extending cylindrical opening 12 which is horizontally disposed and defined by an inner cylindrical surface 13, the diameter of the opening being maximized without impairing the strength of the generally cylindrical wall 14 of the yoke 8. A single, ½ inch thick wearplate 15 is positioned between the top 16 of the yoke 8, closest the railroad car, and the adjacent underside 17 of the housing 6.

Figure 4:
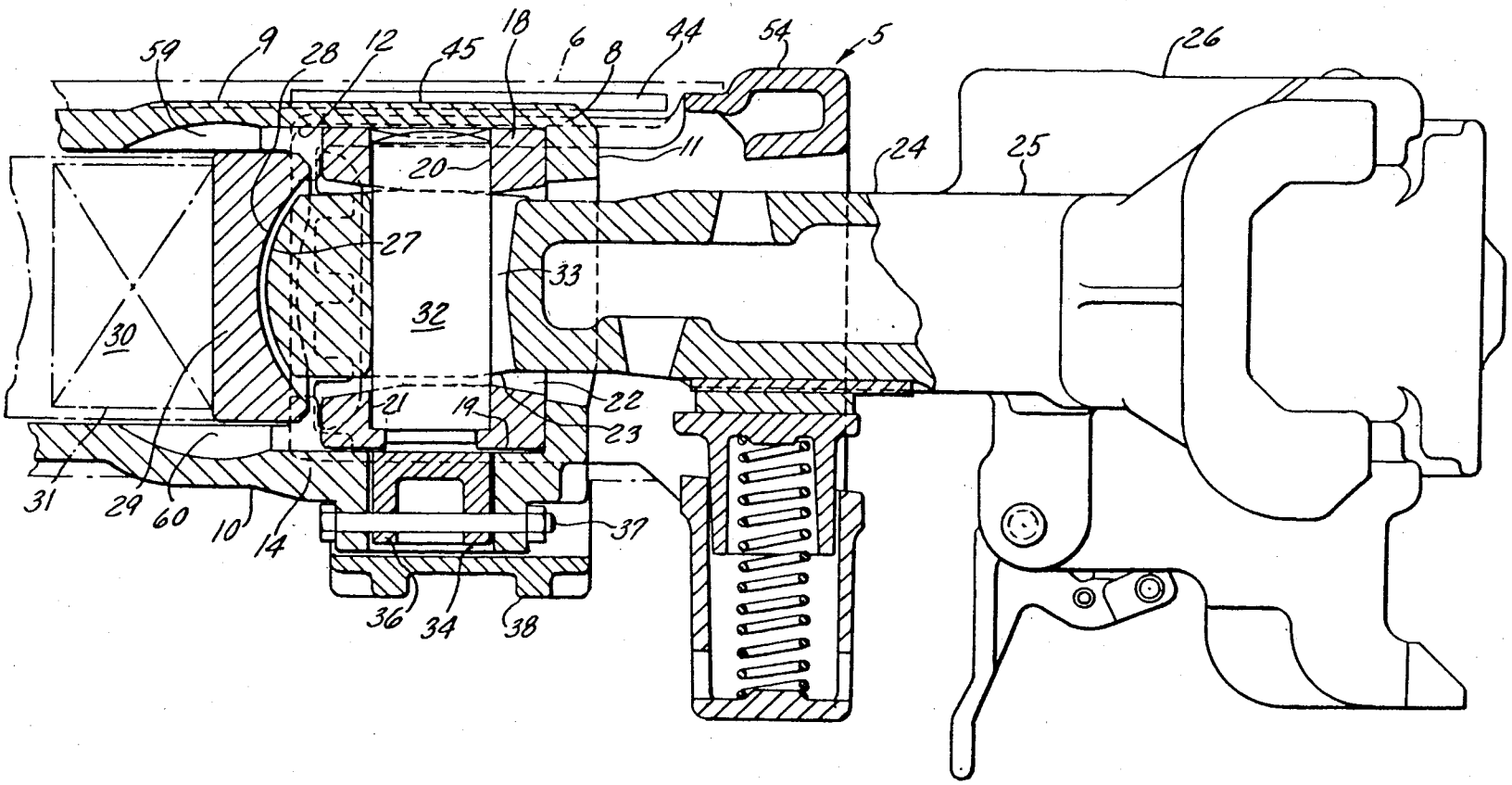
FIG. 4 is a section of the coupler assembly viewed from the line 4—4 of FIG. 2.
Figure 5:
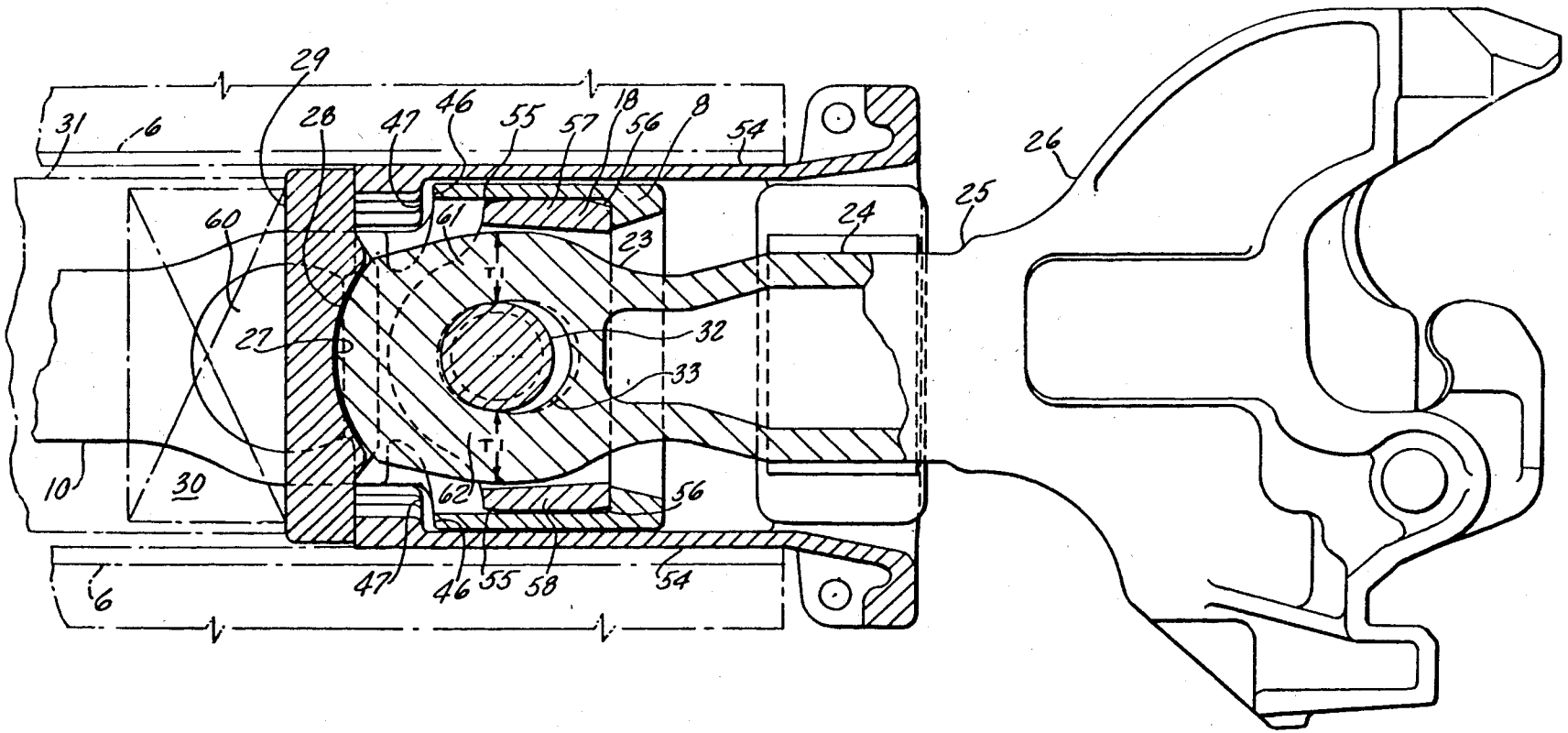
FIG. 5 is a section of the coupler assembly viewed from the line 5—5 of FIG. 2.

A rotary connector 18 is mounted within the opening 12 of the yoke 8 for rotation about the longitudinal axis of the yoke 8. The rotary connector 18 has an outer cylindrical surface 19 which is formed on a radius which is slightly smaller than the correspondingly measured radius used to form the inner cylindrical surface 13 of the yoke 8. The rotary connector 18 has a pair of vertically aligned pinholes 20,21, which extend transversely from a horizontal opening 22 that is formed longitudinally through the rotary connector 18 and is specially configured to receive the inboard end 23 of a coupler shank 24 that, as best seen in FIGS. 4,5, has an out-board end 25 with an attached AAR Standard F coupler head 26. The coupler shank 24 has a generally spherical butt end 27 which seats against a mating concavity 28 of a front follower 29 which is spring loaded in the direction of the coupler head 26 by any suitable means, e.g. stacked rubber cushion pads 30 of a draft gear 31.

The inboard end 23 of the rotary F coupler is pinned to the rotary connector 18 by means of a pivot pin 32 which extends through a pinhole 33 in the inboard end 23 of the coupler shank 24, adjacent the butt end 27, into the aligned pinholes 20,21, of the rotary connector 18. The pivot pin 32 is slidably inserted into the aligned pinholes of the coupler shank and surrounding rotary connector through an opening 34 in the bottom 35 of the yoke 8. The axial movement of the yoke and attached rotary connector and car coupler longitudinally of the housing is conventionally restricted by stops in the yoke and striker and by the coaction of the draft gear assembly, including the cushion pads and front follower.

Figure 2:
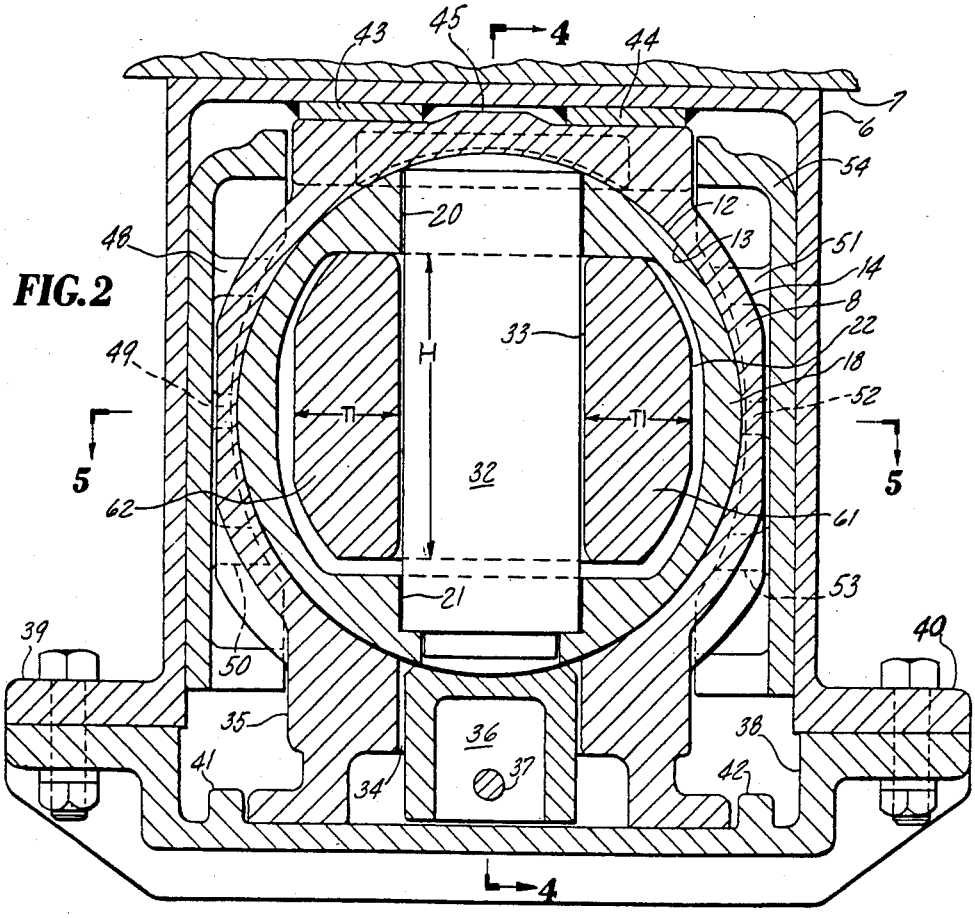
FIG. 2 is a similar cross-section of a rotary F car coupler assembly which is made in accordance with the invention.

A pin block 36 is secured by any suitable means, e.g. a bolt 37, in the bottom opening 34 of the yoke 8 to close the opening 34 and retain the pivot pin 32 vertically in position within the rotary connector 18. The pivot pin 32 is shown in FIGS. 2 and 4, as being alternately vertically supported in the pinhole free of the pin block 36 on a pair of opposing ledges which extend into the pinhole. A cover plate 38 is bolted to the laterally extending flanges 39, 40 of the housing 6 to close the opening in the housing and support the yoke 8. The cover plate 38 is provided with a pair of upstanding stops 41,42 which, together with the striker, restrict lateral and rotational movement of the yoke 8 within the housing 6.

THE INVENTION

As previously indicated, it is desirable to increase the size of the coupler shank adjacent the pinhole to increase the strength and resistance of the coupler shank in this area to fracturing and eventual breakage. Further, it is important to increase the strength of the coupler shank without diminishing the strength of the other components, such as the yoke and rotary connector. This has been accomplished in the following manner.

With particular reference to FIGS. 2–5, the single ½ inch thick wearplate of FIG. 1 is replaced by a split wearplate or twin parallel wearplates 43,44, which have a reduced ⅜ inch thickness to increase the overall height of the yoke 8 within the housing 6 while providing amply thick wearplates between the housing and yoke. The twin wearplates 43,44 are spaced apart a distance of about 3 inches which is sufficient to further heighten the yoke 8 by extending the top portion 45 of the yoke 8, between the wearplates 43,44, upwardly about ¼ inches closer the housing 6 so that there will be an adequate clearance of about ⅛ inches between the yoke and housing. Thus, the height of the yoke 8 is expanded so that the radius of the cylindrical opening 12 within the yoke 8 can be increased by about 7/16–½ inches to substantially enlarge the cross-sectional area of the opening 12, since the area increases with the square of the radius. It is important to note that the overall size of the larger yoke 8 is not that radically increased that it won't fit into a standard carsill housing 6.

Figure 3:
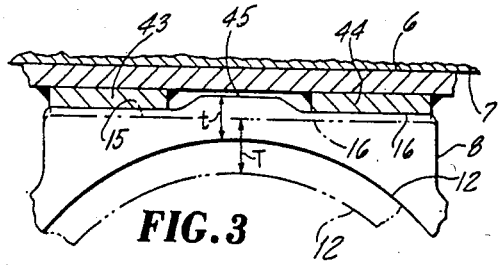
FIG. 3 is a portion of the cross-section of FIG. 2 enlarged to illustrate the difference between the top portions of the prior art yoke of FIG. 1 and the improved yoke of FIG. 2.

It can be appreciated from FIG. 3 that the thickness T of the top 16 of the prior art yoke, shown in dotted line, can be maintained as the thickness t in the top portion 45 of the new improved yoke, while enlarging the opening 12 in the yoke 8. However, to further increase the size of the opening in the yoke, the thickness t of the top portion 45 of the new, bigger yoke 8 is made about 3/32 inches less than the correspondingly measured thickness T of the old prior art yoke. Thus, the sizes of the yoke 8 and rotary connector 18 are increased and maximized without requiring a special carsill housing 6. The front end 11 of the yoke 8 is generally cylindrical throughout its length, as known from U.S. Pat. No. 4,243,149, as compared to the front end of the yoke which is illustrated in U.S. Pat. No. 2,973,105 and has a tapered backside for engaging a tapered rib of the striker. As best seen in FIG. 5, the blunt rearwardly facing end of the improved yoke 8 acts as abutment 46 which is designed to engage adjacent, forwardly facing square shoulders 47 of new improved stops 48–53 carried by the striker 54, rather than the wedge-shaped ribs shown in both the '105 and '149 patents.

The new enlarged rotary connector 18 has a shape similar to that of the rotary connector of the '149 patent, except that it is provided with a pair of oppositely chamfered or beveled edges 55,56 on opposing sidewall portions 57,58 of the rotary connector 18, this being done so that the enlarged rotary connector 18 can be tilted and placed within the yoke straps 9,10, and then rotated into a position as the chamfered edges 55,56 are received in correspondingly dished out grooves 59,60 that are formed in the yoke straps 9,10, adjacent the opening 12 in the yoke 8 and the front follower 29, as best seen in FIGS. 4,5. The reverse procedure is used in removing the yoke.

In prior art yokes, the same sides of the top and bottom yoke straps 9,10, adjacent the front follower, are deliberately made thinner to receive the rotary connector. This differential thickness in the longitudinal sides of the yoke straps is undesirable from a stress resistant viewpoint. This problem is overcome by placing the aforementioned specially configured grooves 59,60 in the top and bottom yoke straps 9,10 between the opposing longitudinal marginal edges of the yoke straps, so that a uniform thickness is maintained at the edges of the yoke straps. However, this necessitates tilting the rotary connector 18, so that it can be inserted between the yoke straps 9,10. By chamfering the opposing edges of the rotary connector, the grooves in the yoke straps are maintained at a minimum desirable depth which does not adversely effect the yoke 8.

With particular reference to FIG. 5, the critical areas of the coupler shank most susceptible to fracturing are in the vertical sidewalls 61,62 of the coupler shank 24 bordering the pinhole 33. The thickness T1 of each of the sidewalls 61,62 has been increased from about 2 inches to about 2½ inches, while the cylindrical pivot pin 32 has been increased in diameter from about 3½ inches to about 3¾ inches. Also, the height H of the coupler shank 24, bordering the pinhole 33, is increased from 5¾ inches to about 6¼ inches. Thus, the coupler shank and pivot pin have been substantially increased in size and strength to provide greater resistance to the increased stresses to which the coupler is being subjected to by the larger railroad cars in service today. The cross-sectional areas of the sidewalls 61,62 have been increased to exceed like areas of the sidewalls of pinholes of prior art shanks of rotary car couplers as well as like areas of the sidewalls of pinholes of prior art shanks of non-rotary F-type car couplers. It can be appreciated from the above that the wear areas of the coupler shank, connector and pin have been substantially increased to prolong the life of these components and the coupler assembly.

Figure 6:
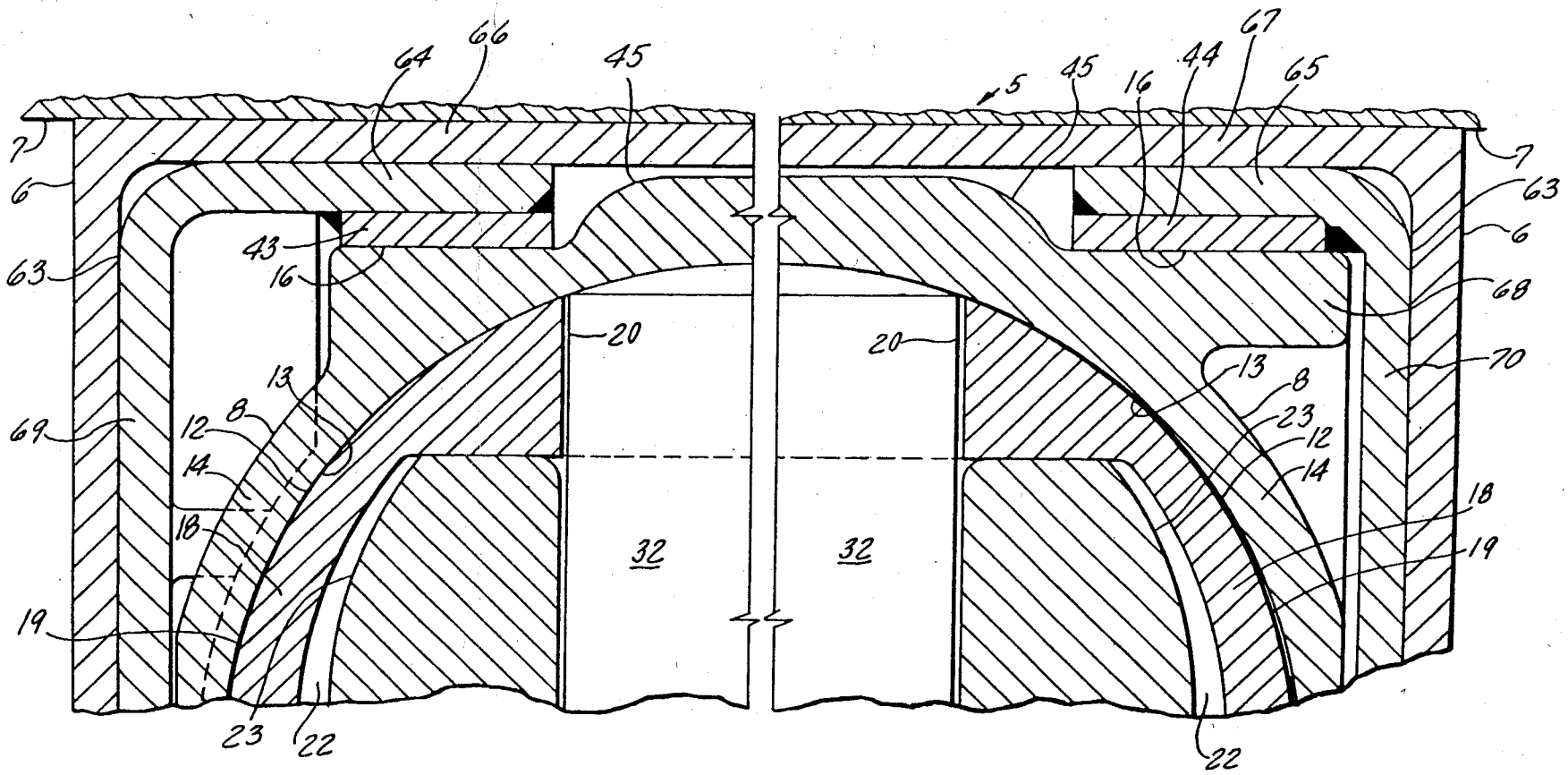
FIG. 6 is a split cross-section of two top portions of a yoke, illustrating two different embodiments of the invention.

With particular reference to FIG. 6, especially the left side of the split cross-section, the twin wearplates 43, 44 are positioned between the top 16 of the yoke 8 and the housing 6 by means of a special striker 63 that has a pair of laterally projecting flanges 64,65 which extend inwardly towards each other and terminate short of the top portion 45 of the yoke 8. The flanges 64,65 of the striker 63 rest against the adjacent top portions 66,67 of the housing 6. The twin wearplates 43,44, in turn, are welded to the underside of the flanges 64,65 of the striker 63 in abutting relation against the adjacent top 16 of the yoke 8.

The top 16 of the yoke 8, as best seen in the right side of the split cross-section, can be extended laterally outwardly by means of a pair of similar, cantilevered flanges or beams 68 which terminate in close proximity to the sidewalls 69, 70 of the striker 63 to restrict lateral and rotational movement of the yoke 8. The flanges 68 of the yoke 8 parallel the flanges 64,65 of the striker 63, and the twin wearplates 43,44 are sandwiched between the parallel flanges 64,65 and 68 of the special striker 63 and yoke 8. It can be appreciated from a visual comparison of the split cross-section, that the use of the cantilevered flanges 68 permits the widening and strengthening of the vertically extended top portion 45 of the yoke 8, as well as the use of wider wearplates 43,44 because of the increased bearing provided by the cantilevered flanges 68.

Thus, there has been described a number of improvements in a railroad car rotary F coupler. The improvements are designed to produce an enlarged rotary connector with undiminished strength while providing a coupler shank that has pinhole sidewalls of increased cross-sectional areas to strengthen the coupler shanks in these highly critical areas and substantially increase the strength of the coupler shank to make it less susceptible to fracturing and breakage. The enlarged rotary connector can be used in conjunction with a bigger, stronger coupler shank that is designed to use either a vertical pin arrangement or a horizontal key-type connection for securing the coupler shank to the rotary connector.

What is claimed is:

1. A rotary railroad coupler assembly mounted within an AAR standard carsill housing which is secured to the underside of a railroad car and wherein said housing has predetermined height and width dimensional limitations, said assembly comprising:

a yoke received in said carsill housing in spaced relation from the underside thereof and including a front end having an opening extending therethrough with a pair of opposed, transversely spaced apart first and second straps extending rearwardly therefrom parallel to the yoke's longitudinal axis, a section of the inner wall of each of said first and second straps adjacent said front end having an arcuate concave conformation transverse to said yoke axis for defining a generally cylindrical rotary connector receiving chamber, and a dished out portion on the inner wall of each of said straps spaced rearwardly from said front end in communication with said section of the associated strap and, a generally cylindrical rotary connector adapted to be positioned within said receiving chamber and freely rotated about said yoke longitudinal axis, said connector having an outside diameter greater than the transverse distance between said straps except at said sections and dished out portions, said connector including a body portion having an axial length less than the minimum transverse distance between said straps and having a pair of oppositely beveled outwardly facing edge portions provided on opposing side wall portions thereof, said beveled edge portions cooperating with the dished out portions of said straps during the process of positioning said connector in said yoke for allowing said connector to be rotated about an axis normal to the connector longitudinal axis and permitting said conector to be generally coaxially located in said receiving chamber, whereby said yoke may accomodate a larger rotary connector which is adapted to permit the coupler assembly to accommodate a larger, sturdier coupler shank.

2. The coupler assembly of claim 1 wherein said dished out portions have generally concave spherical conformations.

3. The coupler assembly of claim 1 wherein the transverse distance between said sections is less than the transverse distance between said dished out portions.

4. A method for mounting a rotary connector within a yoke of a rotary-type railway car coupler assembly to be mounted within an AAR standard carsill housing of a railway car wherein said housing has maximum height and width dimensions and wherein it is desired to maximize the diameter of said rotary connector within predetermined space limitations, said method comprising the steps of:

configuring the yoke to have a front end including an opening extending therethrough and a pair of opoosed first and second straps extending rearwardly therefrom parallel to the yoke longitudinal axis, a section of the inner wall of each of said first and second straps adjacent said front end having an arcuate concave conformation transverse to said yoke axis for defining a generally cylindrical connector receiving chamber, and a dished out portion in the inner wall of each strap spaced from said front end in communication with the associated section;

providing a generally cylindrical rotary connector having an outer diameter greater than the transverse distance between said straps except at said sections and dished out portions, the body of said rotary connector having an axial length less than the minimum transverse distance between said straps and including a pair of oppositely beveled outwardly facing edge portions provided on opposing side wall portions thereof;

inserting said rotary connector within said yoke between said first and second straps such that a front surface of said rotary connector is parallel to an inner surface of one of said straps;

positioning said rotary connector such that said beveled edge portions are facing said straps; and, rotating said rotary connector by approximately 90° about an axis normal to the connector longitudinal axis such that said front surface assumes an approximately perpendicular orientation to the yoke longitudinal axis, said connector beveled edge portions nesting in a respective one of said yoke dished out portions during the step of rotating.

5. The method of claim 4 further including the step of subsequently moving said rotary connector axially of said yoke toward said front end into said connector receiving chamber.

6. The method of claim 5 further including the step of subsequently rotating said rotary connector by approximately 90° about the connector longitudinal axis so that a pair of aligned apertures passing through a pair of ears extending axially from said connectory body are placed in alignment with a transverse aperture in said yoke front end for allowing said yoke and rotary connector to be interconnected.

* * * * *